US006131835A

United States Patent [19]

Johnson

[11] Patent Number: 6,131,835

[45] Date of Patent: Oct. 17, 2000

[54] METHODS FOR TREATING ORES

[75] Inventor: Alvin C. Johnson, Tempe, Ariz.

[73] Assignee: MG Technologies, Inc., Reno, Nev.

[21] Appl. No.: 08/990,524

[22] Filed: Dec. 15, 1997

Related U.S. Application Data

[60] Provisional application No. 60/056,253, Aug. 29, 1997.

[51] Int. Cl.[7] ..... B02C 19/12

[52] U.S. Cl. ..... 241/21; 75/710; 241/30; 241/172

[58] Field of Search ..... 75/711, 710, 743; 241/172, 30, 21

[56] References Cited

U.S. PATENT DOCUMENTS

| | | | |
|---|---|---|---|
| 4,162,045 | 7/1979 | Katzer et al. . | |
| 4,268,307 | 5/1981 | Michel . | |
| 4,979,686 | 12/1990 | Szegvari et al. | 241/172 |
| 5,123,956 | 6/1992 | Fernandez et al. . | |
| 5,232,491 | 8/1993 | Corrans et al. | 75/743 |
| 5,236,492 | 8/1993 | Shaw et al. . | |
| 5,238,485 | 8/1993 | Shubert . | |
| 5,308,381 | 5/1994 | Han et al. . | |
| 5,338,338 | 8/1994 | Kohr . | |
| 5,346,532 | 9/1994 | Sinclair et al. . | |
| 5,375,783 | 12/1994 | Gamblin . | |
| 5,401,296 | 3/1995 | Martenson et al. . | |
| 5,411,574 | 5/1995 | Turney et al. . | |
| 5,425,800 | 6/1995 | Buter et al. . | |
| 5,443,621 | 8/1995 | Kohr | 75/711 |
| 5,458,866 | 10/1995 | Simmons . | |
| 5,529,606 | 6/1996 | Hewlett . | |
| 5,536,294 | 7/1996 | Gill et al. . | |
| 5,536,480 | 7/1996 | Simmons . | |
| 5,542,957 | 8/1996 | Han et al. . | |
| 5,611,839 | 3/1997 | Kohr . | |
| 5,620,585 | 4/1997 | Dadgar et al. . | |
| 5,626,647 | 5/1997 | Kohr . | |
| 5,653,945 | 8/1997 | Gathje et al. . | |
| 5,676,733 | 10/1997 | Kohr . | |
| 5,792,235 | 8/1998 | Kohr | 75/711 |

OTHER PUBLICATIONS

Jacqueline Krim, Scientific American, "Friction at the Atomic Scale", pp. 74–80, Oct. 1996.

Richard W. Siegel, Scientific American, "Creating Nanophose Materials", pp. 74–79, Dec. 1996.

Johnson, Jr., "Could Mother Nature Be the Villain at Busang?", *Engineering and Mining Journal*, pp. 4–5 (Aug. 1997).

Union Process, "Production Batch Attritors for Wet Grinding" Grinding Media Pamphlet.

Iler, "The Chemistry of Silica" (1979).

Bond, "Heterogeneous Catalysis: Principles and Applications", Second Edition (1987).

Ammen, "Recovery and Refining of Precious Metals", pp. 10–14 (1984).

Brack, "Metal Clusters and Magic Numbers", *Scientific American*, pp. 50–55 (Dec. 1997).

Hadjipanayis, et al., "Nanophase Materials Synthesis–Properties–Applications" (1994).

Kallmann et al., "Referee Analysis of Precious Metal Sweeps and Related Materials", *Talanta*, 30:1, pp. 21–39 (1983).

*Primary Examiner*—Mark Rosenbaum

*Attorney, Agent, or Firm*—McDermott, Will & Emery

[57] ABSTRACT

Metals are rendered analyzable, extractable or recoverable from materials, such as complex or refractory ores, by applying shear deformation forces to the materials. The shear deformation forces are generated by methods such as mechanical attrition. Through this process, the precious element-bearing amorphous colloidal silica and other fractions of these ores are reformed and crystallized into what are essentially nanophase materials that show a change of chemical, mechanical, and thermodynamic properties as compared to their original natural state. During or after this transformation, the precious element content of these ores may be reduced to a recoverable state and/or analyzed or detected.

16 Claims, 9 Drawing Sheets

METHODS FOR TREATING ORES

This application is based on U.S. provisional patent application Ser. No. 60/056,253, filed Aug. 29, 1997, the entire disclosure of which is incorporated herein by reference.

FIELD OF THE INVENTION

The present invention generally relates to methods for recovering or extracting elements from materials, such as complex or refractory ores, which contain amorphous colloidal silica units ("a.c.s. units") and the like, and, in particular, to methods for recovering or extracting so-called precious metal elements associated with such a.c.s. units. The present invention is also directed to materials treated by the inventive method, and, in particular, to a treated complex or refractory ore. The present invention is further directed to methods for transforming elements, which are found in materials, such as complex or refractory ores, into assayable, analyzable or otherwise detectable forms using conventional techniques.

BACKGROUND OF THE INVENTION

Several methods have been described in the literature for analyzing, assaying, recovering or extracting elements, especially precious elements, from ores. For example, when attempting to ascertain the total gold content of an ore sample, a so-called fire assay process is typically used. See, e.g., Kallmann, S. and Maul, C., "Referee Analysis of Precious Metal Sweeps and Related Materials," *Talanta,* 30(1):21–39 (1983). In the fire assay process, metals are dissolved and extracted using molten lead. The lead and precious metals are separated in a secondary process called cupellation and then the gold content of the precious metals collected in the fire assay process is determined using a variety of analytical techniques. When using the fire assay process on a so-called complex or refractory ore to determine total elemental content, the results achieved typically lead to the conclusion that no economically feasible recoverable elements, especially precious elements, e.g. gold, are contained therein. It would be beneficial if the amount of elemental values assayed and/or recovered from complex or refractory ores could be increased through an economically/commercially feasible method.

The problems associated with the extraction of elements, especially so-called precious elements, e.g., transition elements, base metals, lanthanides and the like, from complex or refractory ores are well known. Generally, conventional methods have been limited to recovering precious metal values, such as gold, on the order of about 0.05 troy ounces per ton of ore or less. Further, thermal-based methods, such as high-temperature roasting and thermiting, whereby precious metal ions in refractory ores are reduced, have led to undesirable formation of alloys with predominating natural based metals, such as Fe and Cu. These high temperature-formed alloys are highly refractory such that any precious metal values contained therein are typically extracted with great difficulty when subjected to subsequent smelting or hydrometallurgical treatment. In addition, chemical methods using a variety of lixivants, such as cyanide heap leaching, which uses environmentally unfriendly NaCn, have been used, but with scant results.

Accordingly there remains a need for better and reliable methods that are capable of making metals contained in materials, such as complex or refractory ores, assayable, analyzable or otherwise detectable using conventional techniques. In addition, there is a need for economical and commercially feasible methods for recovering or extracting elements, especially precious metal elements, from materials such as low grade, complex or refractory ores, including, without limitation, basaltic ores, alluvial ores and the like.

SUMMARY OF THE INVENTION

Extensive testing of various rock-types throughout the Western Hemisphere and parts of the Pacific Basin has demonstrated the occurrence and widespread distribution of a heretofore unknown complex or refractory ore-type containing considerable amounts of recoverable Au, Ag, Pt, Pd, Rh, Ir, other transition elements, base metals, etc. Without wishing to be bound by the following theory, the uniqueness of this ore-type is believed to be due, in part, to the existence of naturally-occurring particles of a.c.s. units associated with counterions (largely in the form of cations) of elements, especially counterions of precious metal elements. It is important to note that the existence of amorphous colloidal silica has been described in the literature. See, e.g., Iler, R., "The Chemistry of Silica," (1979). However, the presence of naturally-occurring a.c.s./counterion units, much less the treatment of such a.c.s./counterion units to render elements in a complex or refractory ore assayable or detectable therefrom, as well as to recover such elements or precious metal elements, as more fully described below, has heretofore not been known. These naturally-occurring a.c.s. units may be described as a precursor support or substrate that behaves like natural ion-exchange substrates that essentially "lock" the counterions of elements, thereby making them very resistant to smelting and hydrometallurgical treatment. For instance, when smelted, it is believed that these silica-based particles tend to migrate to the molten slag and continue functioning as an ion exchange media, thereby perpetuating its undesirable characteristic of rendering the counterions non-analyzable, non-reducible or unavailable for recovery or extraction using conventional techniques.

Accordingly, it is an object of the present invention to provide a simple and efficient method for transforming or treating amorphous colloidal silica/counterion units ("a.c.s./counterion units") so as to render the metal counterions assayable, analyzable or otherwise detectable, as well as reducible, recoverable or otherwise extractable therefrom.

It is also an object of the present invention to provide a simple and efficient method for recovering or extracting metals, especially precious metals, from complex or refractory ores.

It is a further object of the present invention to provide a simple and efficient method for transforming or making metals, especially precious metals, which are found in complex or refractory ores, analyzable using conventional analytical methods or apparatus such as, without limitation, traditional fire assay methods, atomic absorption spectroscopy, plasma emission spectroscopy, x-ray fluorescence, plasma mass spectroscopy, neutron activation analysis, etc.

It is still a further object of the present invention to provide a method for recovering or extracting metals, especially precious metals, without the use of environmentally hazardous chemicals that have been used in previous metal detection or extraction methods.

In accordance with the above and other objects, one embodiment of the present invention comprises treating a material containing a.c.s./counterion units, such as a complex or refractory ore, by applying a sufficient amount of shear deformation forces thereto. The shear deformation forces may be generated and applied by using, for example, a media or ball mill. After the application of shear deformation forces, the resulting treated material optionally may be further subjected to a sintering/annealing step involving the application of sufficiently high temperatures in an inert atmosphere, e.g., using a conventional belt furnace with a hydrogen atmosphere and nitrogen aprons.

Another embodiment of the present invention comprises a treated material, e.g., a treated complex or refractory ore, that is obtained from the present inventive method. When viewed through a low power microscope, the treated material may be characterized, without limitation, by the presence of agglomerations of elements, such as precious metal elements, that are produced during the sufficient application of shear deformation forces to the subject material. It is believed that the agglomerations are formed through accretion that occurs as a result of the continuous application of shear deformation forces. The treated material may be sold and further smelted or refined to recover or extract the elements contained therein by using conventional extraction methods including, but not limited to, gravimetric, magnetic, volumetric or titrimetric methods, ion electrode methods, ion chromatography, induction furnace methods and the like.

Additional objects and attendant advantages of the present invention will be set forth, in part, in the description and examples that follow, or may be learned from practicing or using the present invention. These and other objects and advantages may be realized and attained by means of the features, instrumentalities and/or combinations particularly described herein. It is to be understood that the foregoing general description and the following detailed description are only exemplary and explanatory in nature and are not to be viewed as limiting or restricting the invention, as claimed.

DESCRIPTION OF PREFERRED EMBODIMENTS

Figure 1:
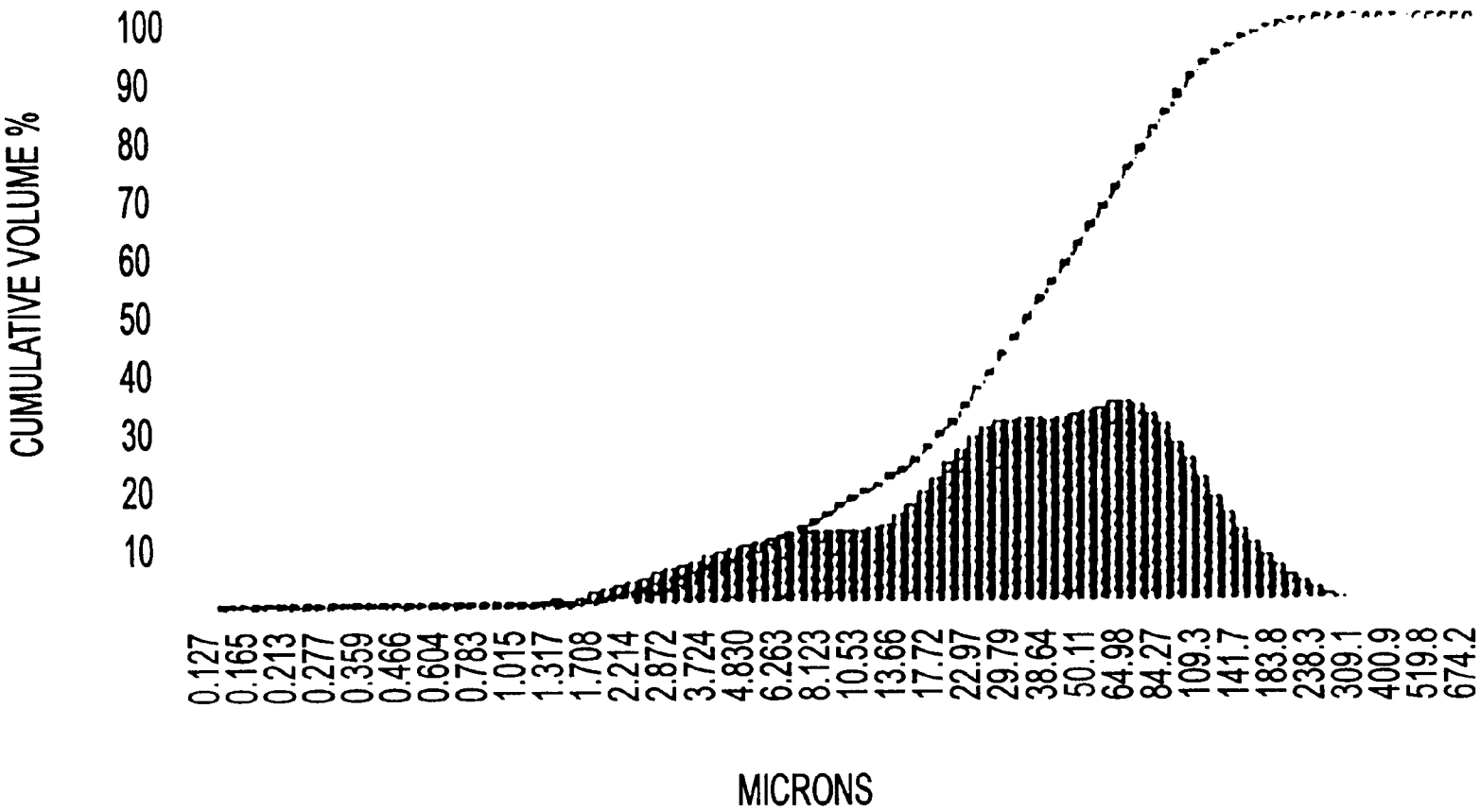
FIGS. 1–9 show particle size distribution data, collected in one hour increments, for a 1 kg sample of basaltic ore that has been mechanically attrited in accordance with the principles of the present invention.

All patents, patent applications and literatures that may be cited in this application are incorporated herein by reference in their entirety. In the case of inconsistencies, the present disclosure, including definitions, will prevail.

As an aid to understanding, but without wishing to be bound thereby, the present invention is based, in part, on the discovery that certain materials, such as complex or refractory ore-types, contain considerable amounts of recoverable transition elements (precious metals such as Au, Ag, Pt, Pd, Rh, Ir), other elements, base metals, the interfering Group V-A and VI-A counterions such as As, Sb, S, Se, and Te, etc. (for convenience sake, collectively herein referred to as "elements" or "metals"). As stated above, it is believed that a feature of these ores is the presence of naturally-occurring or naturally-formed amorphous colloidal silica units or particles ("a.c.s. units") that essentially act as ion exchange substrate/media/support for metallic counterions (typically in the form of cations). The naturally-occurring a.c.s. units are believed to be colloidal in size, i.e., within the nanometer size range, and possess colloid-like properties. The metal counterions are chemisorbed, bonded onto, molecularly complexed or otherwise associated with these a.c.s. units to form a.c.s./counterion units. Each a.c.s./counterion unit appears to have hybrid physiochemical properties that are derived from both silica and the metal counterion. The metal counterions in naturally-occurring a.c.s./counterion units are very resistant to conventional assaying, recovery or extraction methods, such as the fire assay method, acid dissolution, leaching, hydrometallurgical, smelting, etc.

By applying a sufficient amount of shear deformation forces to a material containing such a.c.s./counterion units, e.g., a complex or refractory ore, the a.c.s./counterion units are transformed/converted into nano-sized or nanophase materials ("nanocrystalline") that exhibit thermodynamic, mechanical, and chemical properties that are different from those of the precursor a.c.s./counterion units. Although encapsulated elements or metal values can be released through the application of shear deformation forces, it is the transformation/conversion of the a.c.s./counterions that is a primary goal of the present invention. If the shear deformation forces applied to a material are inadequate, then the conversion to nanophase metal/metallic alloys and compounds will be inefficient. For instance, only those elements with relatively lower melting points, such as silver in the case of precious metals, are likely to be involved in any nanophase-type alloying, compounding, or reduction. It is further believed that through the application of shear deformation forces, potential energy is pumped into, and stored within, crystal lattice defects and grain boundaries of the a.c.s. portion of the a.c.s./counterion units. It is the storage of this mechanical or potential energy that causes a change in the thermodynamic, mechanical, and/or chemical properties of the a.c.s./counterion units. While other methods or means can be used to add energy into an a.c.s. portion of the a.c.s./counterion units, such as the use of chemical reducing agents, die pressing/briquetting, microwaves, infrared energy, laser ablation, plasma gas formation, anode leaching, etc., it is the application of shear deformation forces that is most preferred.

Depending on the length of application time and the magnitude of the shear deformation forces used, the size of the a.c.s./counterion unit can effectively be decreased to within the nanosize range, e.g., 25 nm or less. Once the a.c.s./counterion units within a material are within the nanosize range, it becomes more efficient for the shear deformation forces to store potential energy within the a.c.s. portion of the a.c.s./counterion unit. As more potential energy is stored, it is believed that the a.c.s. portion of the a.c.s./counterion units begin to crystallize or become transformed from their amorphous state into a nanocrystalline state. At the same time, the metal counterions become reduced to metal, metallic and non-metallic alloys and other various compounds. In essence, it is believed that the a.c.s. portion of the a.c.s./counterion unit "releases" the sought after metal counterion unit. As a result, the metal counterions are thereby reduced to metal or form alloys that are analyzable, extractable or recoverable from the material, e.g., ore, using any suitable conventional means.

In one aspect, the present invention resides in a method for treating a material containing a.c.s./counterion units so as to render the counterions analyzable, reducible, recoverable or otherwise extractable from the material as elements, the method comprising the step of applying shear deformation forces to the material. In another aspect, the present invention resides in a method for extracting or recovering a metal contained in a complex or refractory ore, comprising: applying shear deformation forces to the ore to transform the metal into an extractable or recoverable form, and extracting or recovering the metal. Through the application of a sufficient amount of shear deformation forces, the a.c.s. portion of the a.c.s. counterion units is reduced to a nano-sized or nanophase material.

Any method may be used to apply shear deformation forces in accordance with the principles of the present invention so as they are generally capable of storing or pumping mechanical energy into an a.c.s. unit. Examples of such methods include, without limitation, mechanical attrition, sputtering, electrodeposition and inert gas condensation. It should be noted, however, that mechanical attrition techniques are most preferred.

Through the use of mechanical attrition techniques, the shear deformation forces are typically applied in the form of mechanical energy that may be cyclic or linear in nature. For example, cyclical shear deformation forces may be generated or applied by conventional mechanical attrition methods using any appropriate means, such as a media or ball mill, stirred ball mill, vibrating ball mill, cone mill, pug mill or rod mill. In addition, linear shear deformation forces may be generated or applied by using a conventional apparatus, such as a disc mill or certain types of mullers. Although an impact or hammer mill may be used, it is not as preferred because sufficient shear deformation forces are not efficiently generated thereby.

In a preferred embodiment, high energy attritor/grinding devices equipped with a comminuting vessel, grinding media and optionally stirring arms may be used. The mill may also be equipped with a three horse power variable speed motor, an RPM gauge and a sealed top cover for the application of inert gases. These types of attritors are sometimes generically referred to as "media" or "stirred ball" mills. It is noted that attritors are preferred because the following mechanical attrition parameters can be controlled: the composition and size of the grinding media; the number and velocity of stirring arms, i.e., revolutions per minute; the impact velocity/shearing force of the grinding media; the time or length of treatment; and the atmosphere within the attrition mill. In operation, the comminuting vessel may be capped off to prevent the infiltration of oxygen or a reducing atmosphere of nitrogen or argon gas may be introduced into the comminuting vessel using any suitable means.

Examples of conventionally available attritors that may be used in accordance with the principles of the present invention include, without limitation, the Spex 8000™ (SPEX Industries, Inc., Edison, N.J.) and the dry grinding batch attritors manufactured by Union Process, Inc. of Akron, Ohio. A preferred high speed media mill that may be used in accordance with the principles of the present invention is described in U.S. Pat. No. 4,979,686 to Szegvari et al., the entire disclosure of which incorporated herein by reference.

Prior to the application of shear deformation forces generated by an attritor, it is preferred to prepare the material containing a.c.s/ counterion units by crushing or pulverizing it to an average mesh size of about −100 mesh or less (149 microns, U.S. standard). The purpose of such crushing or grinding preparation of the material is to allow the efficient transfer and storage of energy into the a.c.s./counterion units by providing more surface area for the shear deformation forces to be applied. Although materials having a larger mesh sizes (−100 mesh or more) may be used, such larger mesh sizes tend to decrease the amount of energy that is effectively stored because more energy is exerted or used to crush the ore, thereby affecting the overall efficiency of the process. Conventional means that may be used to prepare the material to have the preferred mesh size include, without limitation, an impact mill, crushers (roll, traditional jaw and oscillating jaw), pulverizers (small ring, large ring, plate), and the like. For example, a pulverizing ring mill typically consists of a bowl that contains either a small puck and one or more rings, or a large saucer. Material is added to the bowl, which is then is sealed and subjected to centrifugal force by mechanical action. The puck and/or ring(s), which are free to move inside the bowl, subject the material to considerable grinding action, resulting in the desired mesh size.

The shear deformation forces are preferably applied to a material containing a.c.s./counterion units under dry conditions using a continuous dry grinder or media (ball) mill. Although the shear deformation forces may be applied in wet grinder under wet conditions, it is not preferred over dry conditions because water tends to undesirably act as an energy buffer and promotes the formation of large agglomerations of material that prevent energy from being efficiently stored or pumped into the a.c.s. units. Accordingly, the material containing a.c.s./counterion units is preferably subjected to a drying step prior to the application of shear deformation forces. For example, the material may be dried at a temperature of about 50° to about 500° C., preferably 100° to about 450° C., and most preferably about 60° to about 110° C. The drying step is preferably performed for up to about 5 hours or longer, more preferably, up to about 4 hours, and most preferably up to about 3 hours, depending on the water content of the material. Although higher temperatures and/or longer drying times may be employed, care must be taken to prevent the loss of elemental values through volatilization or oxidization at higher temperatures or longer drying times. To perform the drying step, any conventional drying apparatus may used, including, but not limited to, conventional electric oven, gas-heated forced air furnaces, and the like. To ensure efficient heat transfer and minimal drying times, the material may be placed into stainless steel trays or other appropriate holding vessel.

In accordance with the principles of the present invention, it is preferable to continuously apply the shear deformation forces to the material containing a.c.s./counterion units for a time sufficient to transform them into a nanophase state. The velocity (rpm) of the grinding media and stirring arms (if present) within an attritor and the amount of time that is required to apply a sufficient amount of shear deformation forces to a material can vary based on the several factors, including the size of the vessel, the nature of the material being attrited, etc. Preferably, the required velocity is within a range of about 300 to about 1800 rpm, more preferably about 500 to about 1600 rpm, and most preferably about 1000 to about 1400 rpm. Regarding the application time, the shear deformation forces are preferably continuously applied to material containing a.c.s./counterion units for about 4 to about 24 hours or more, more preferably about 5 to about 14 hours, and most preferably, about 6 to about 10 hours.

The type and amount of grinding media used within a media mill are important factors in the generation and application of sufficient shear deformation forces. In general, the grinding media should be of sufficient size, hardness and weight to achieve a high enough impact velocity to achieve shear deformation forces that will add or store energy in the a.c.s. portion of the a.c.s./counterion units. If ball shaped media are used, the diameter of the ball should preferably be about 0.0625" to about 1" in diameter, more preferably about 0.25" to about 0.50" in diameter, and most preferably about 0.125" to about 0.375" in diameter. The ball media can be made of any suitable material, such as, without limitation, manganese steel, carbon steel, stainless steel, chrome steel, zirconia and tungsten carbide, and the like, with case or through hardened stainless steel or carbon steel balls being the most preferred. Further, the balls-to-charge of material ratio within the comminuting vessel is preferably about 3–25:1, most preferably about 4–20:1. As a general guide, if the velocity employed within the attritor is about 500 to about 600 rpm, then the balls-to-charge of material ratio is preferably about 10–20:1. On the other hand, if the velocity employed within the attritor is about 1000 to about 1200 rpm, then the balls-to-charge of material ratio is preferably about 4–12:1.

Grinding aids may be used to prevent or break up large agglomerations or packing of the material within the comminuting vessel and on the grinding media, as well as to insure efficient surface area contact between the grinding media and material. Preferably, the grinding aids should be relatively inert and non-aqueous. During the application of shear deformation forces, the grinding aids may be added periodically to aid in the free flow of the grinding media contained therein. The grinding aids may be separately added in aliquots whenever needed. Generally, the time intervals for addition of grinding aids may range about 15 to about 90 minutes. In addition, if a cooling jacket around the comminuting vessel is used, its temperature should preferably be maintained at less than about 38° C. (100° F.) to prevent agglomeration and vaporization of any grinding aids added to the comminuting vessel. Suitable examples of grinding aids that may be used include, but are not limited to, alcohol, isopropyl alcohol (90% or more), acetone and the like.

To enhance the collection of elements that are made analyzable and recoverable during the application of shear deformation forces, fluxing agents may be added to the material prior to the application of shear deformation forces. Suitable examples of conventionally used fluxing agents include, without limitation, Cu, Fe, Ni, Pb, NaBr, $NH_4Cl$, NaF, NaCn and the like.

During the continuous application of shear deformation forces, a mixture of nanocrystalline and amorphous materials is obtained. To decrease the overall time required to use a mechanical attritor, the treated material optionally may be subjected to a sintering/annealing step involving the application of sufficiently high temperatures in an inert atmosphere. It is believed that a sintering/annealing step allows for grain size refinement of the attrited material wherein the nano-sized crystals are transformed into macro-sized crystals, i.e., classical crystal size. While grain size refinement may be achieved using any suitable method or apparatus, e.g., chemically (using NaBH, HCl, etc.), Oswald aging, infrared bombardment, etc., it is preferred to use a conventional belt furnace comprising an inert atmosphere, e.g., hydrogen, with nitrogen or argon "curtains" at both the head and tail ends. To insure that a constant inert atmosphere is maintained within the belt furnace, an appropriate amount of pressure may be applied. For example, in a laboratory scale belt furnace, the pressure may be maintained without limitation, at about 10 to about 100 p.s.i., more preferably, at about 14 to about 50 p.s.i., and most preferably at about 16 to about 20 p.s.i. Further, the temperature within the furnace may preferably be set to between about 400° to about 1600° C., more preferably about 600° to about 1400° C., and most preferably, about 950° to about 1010° C. The sintering/annealing step may be performed for any suitable amount of time to achieve grain size refinement, preferably for at least about 15 minutes.

In another embodiment, the present invention comprises a treated material containing a.c.s./counterion units, e.g., a treated complex or refractory ore, which is obtained from the present inventive method. When viewed through a low power microscope, the treated material may be characterized, without limitation, by the presence of agglomerations of elements that are produced during the continuous application of shear deformation forces to the subject material. Without being limited by the following theory, it is believed that the agglomerations are produced through accretion of metals/elements as nanocrystalline structures are formed and counterions are released and reduced. The treated material may be assayed or analyzed to determine elemental content using any suitable analytical means. In addition, the treated material may be sold and further refined to concentrate, recover or extract the elements contained therein by using conventional extraction methods including, but not limited to, gravimetric, magnetic, volumetric or titrimetric methods, ion electrode methods, ion chromatography, induction furnace methods and the like. For instance, the treated material may be leached using suitable lixivants such as, without limitation, sodium cyanide, thiourea, sodium or calcium hypochlorite, etc. It is noted that if the head ore is in the order of 100 troy ounces of precious metal per ton, or more, then the entire attrited head ore product may be sintered using the sintering/anneal step described above and the resulting product can then be sold directly to a smelter/refinery for further processing, without the need for further concentrating steps.

Figure 2:
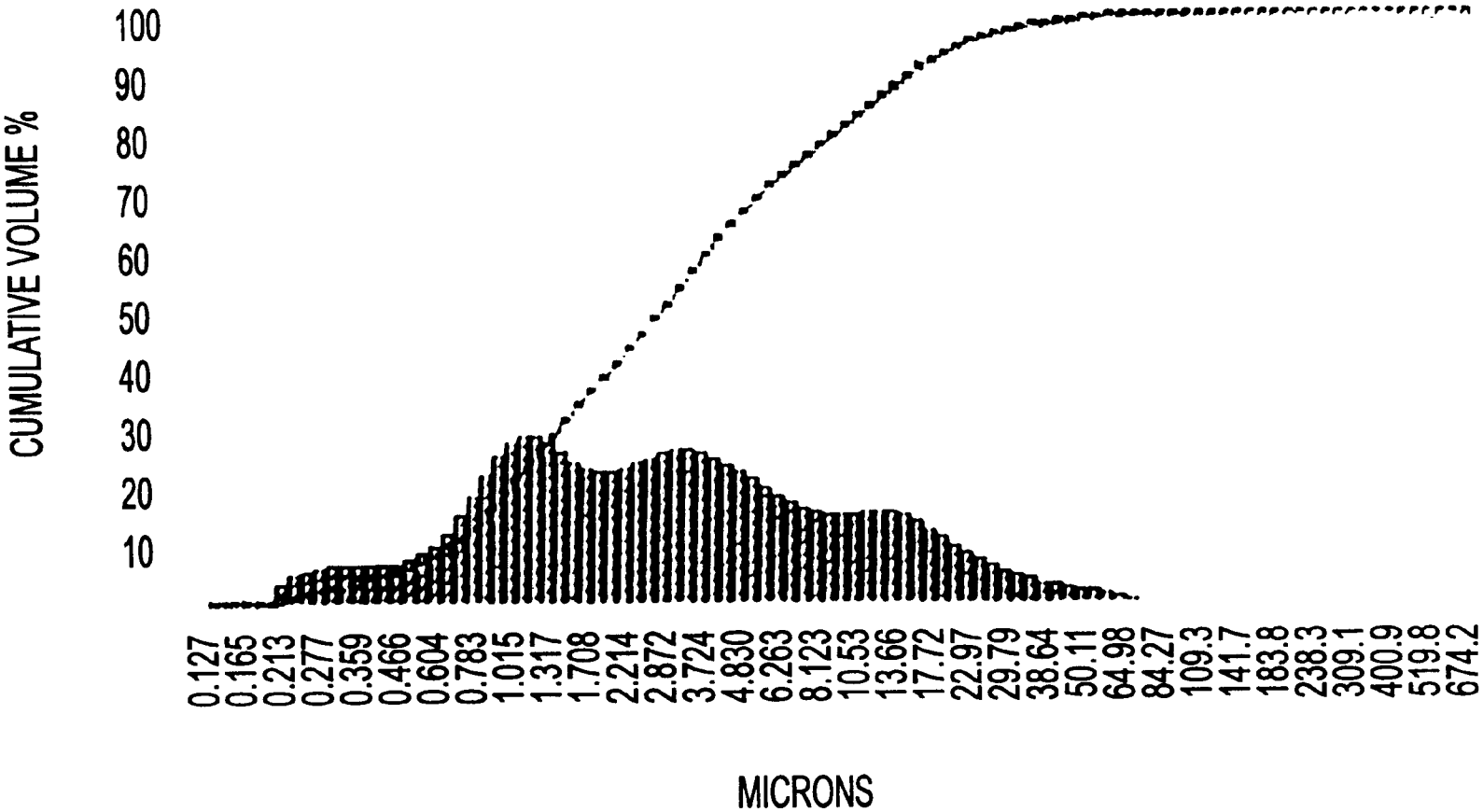
Figure 3:
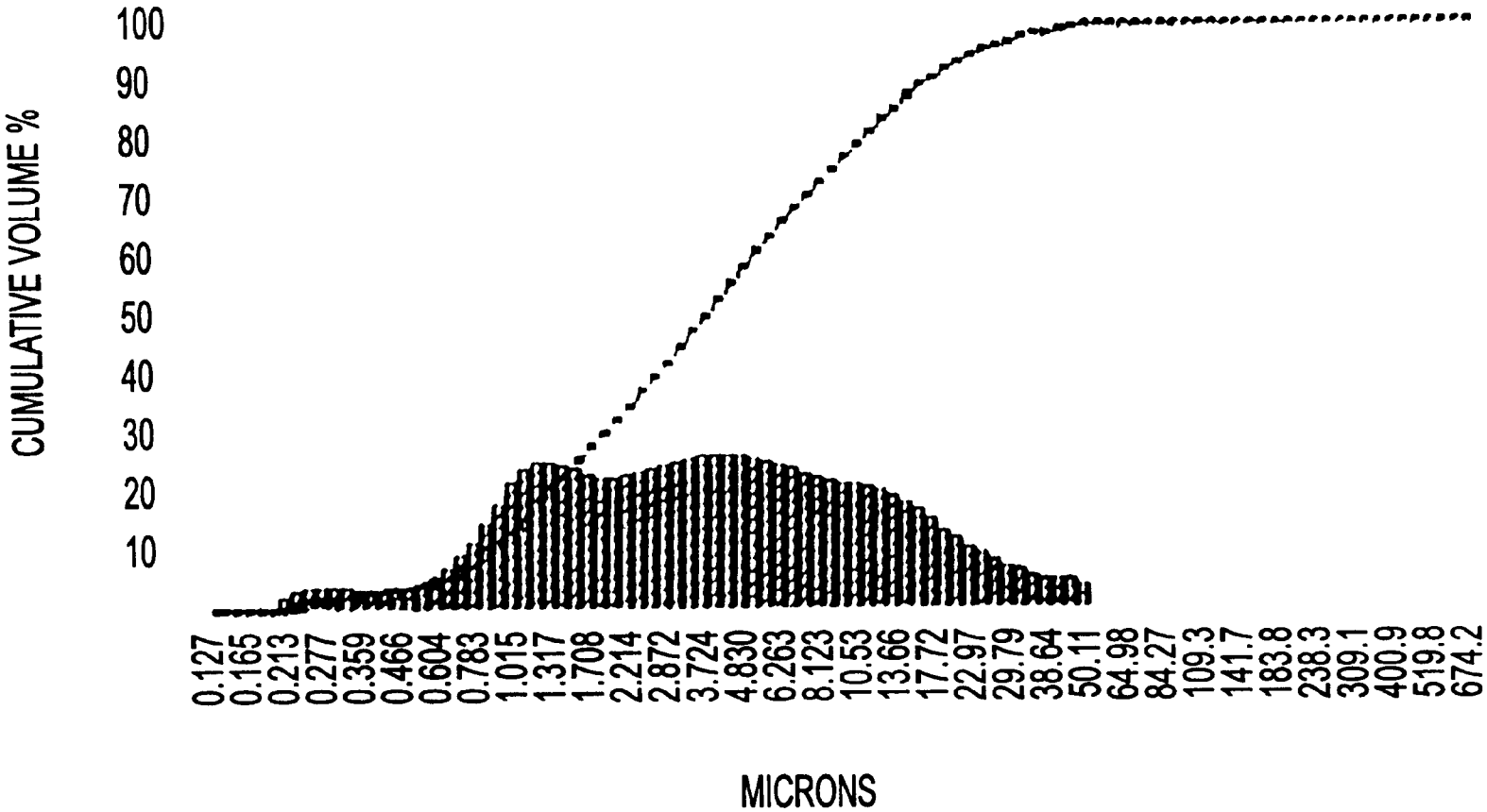
Figure 4:
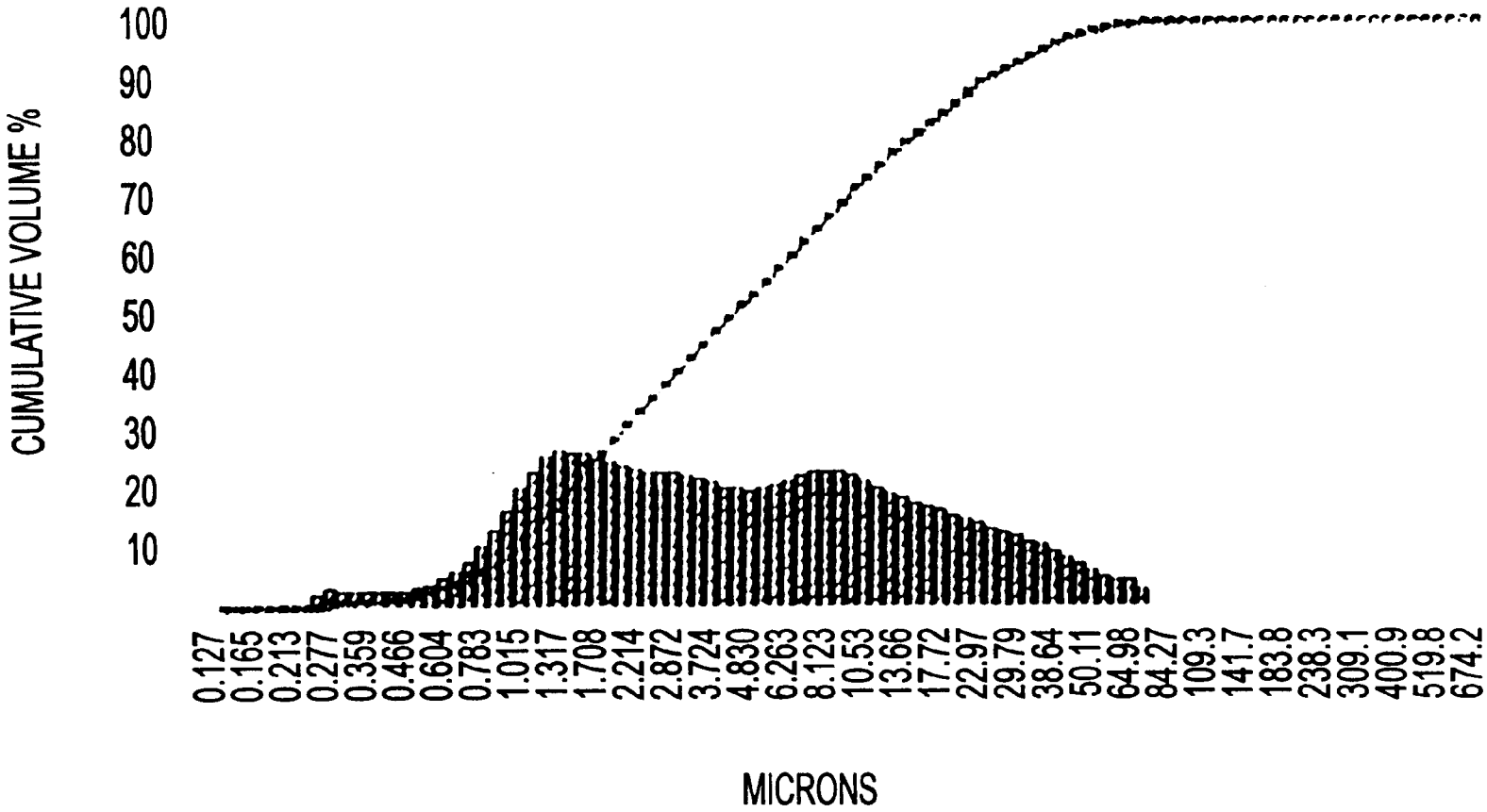
Figure 5:
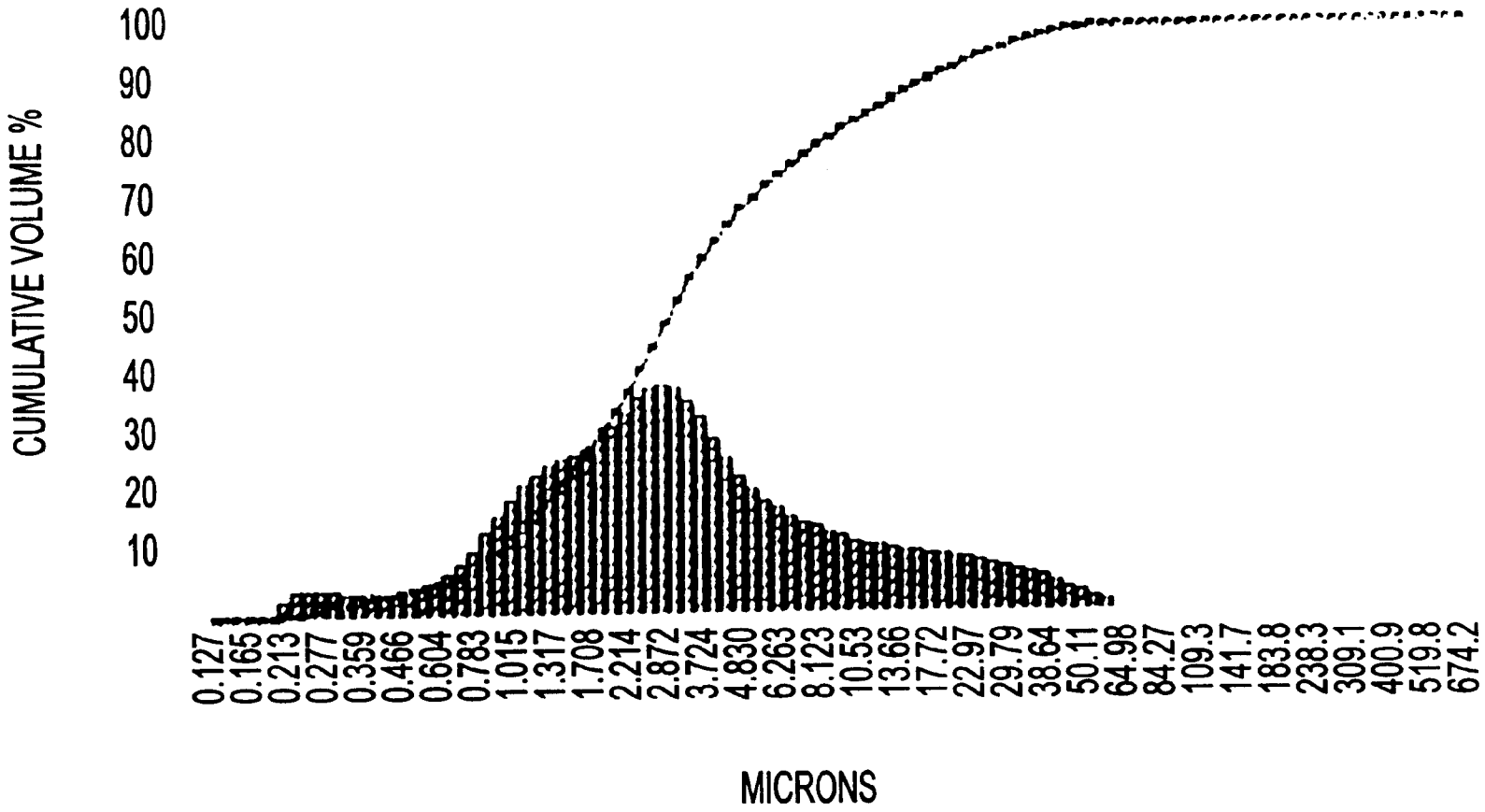
Figure 6:
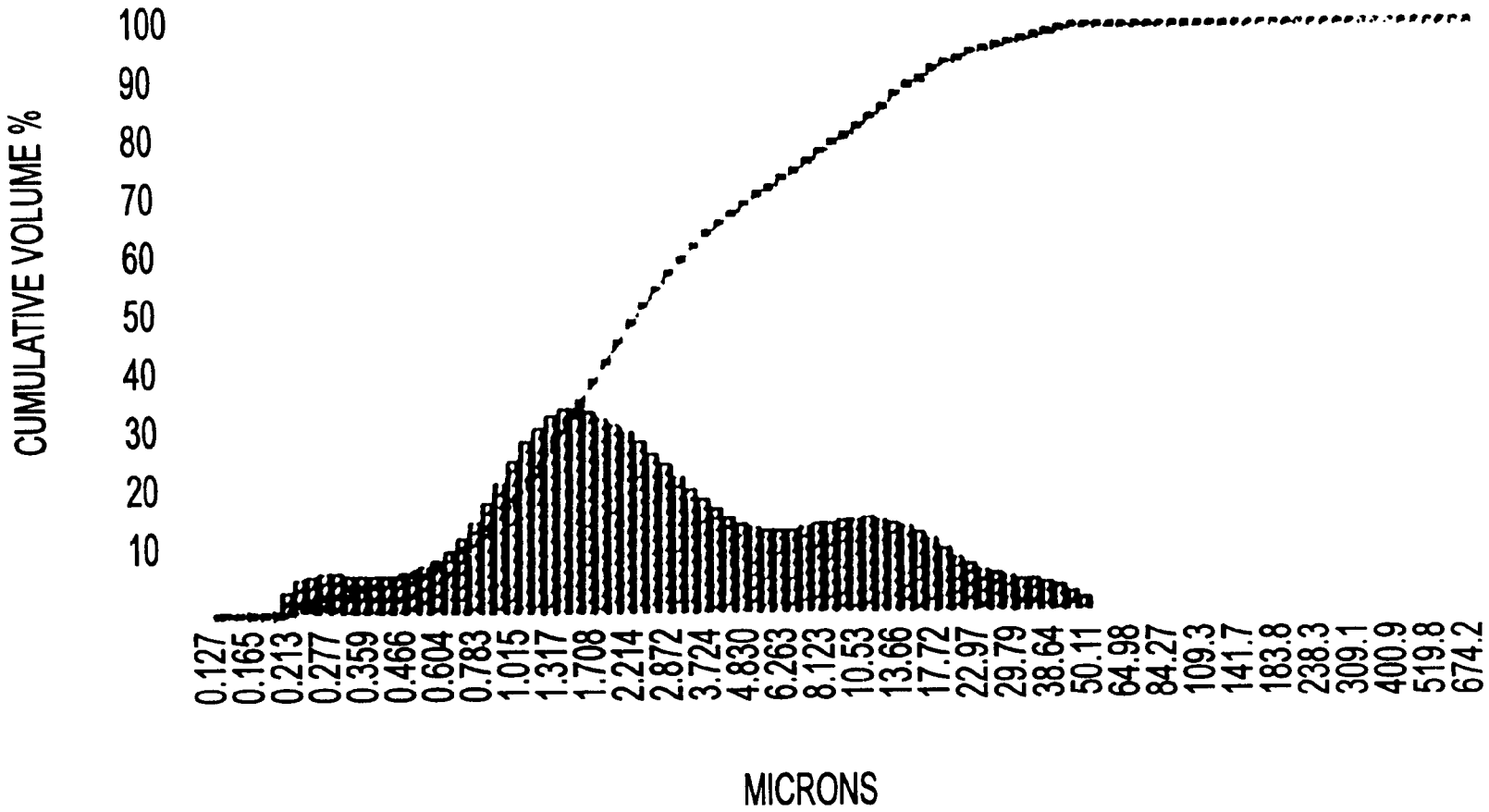
Figure 7:
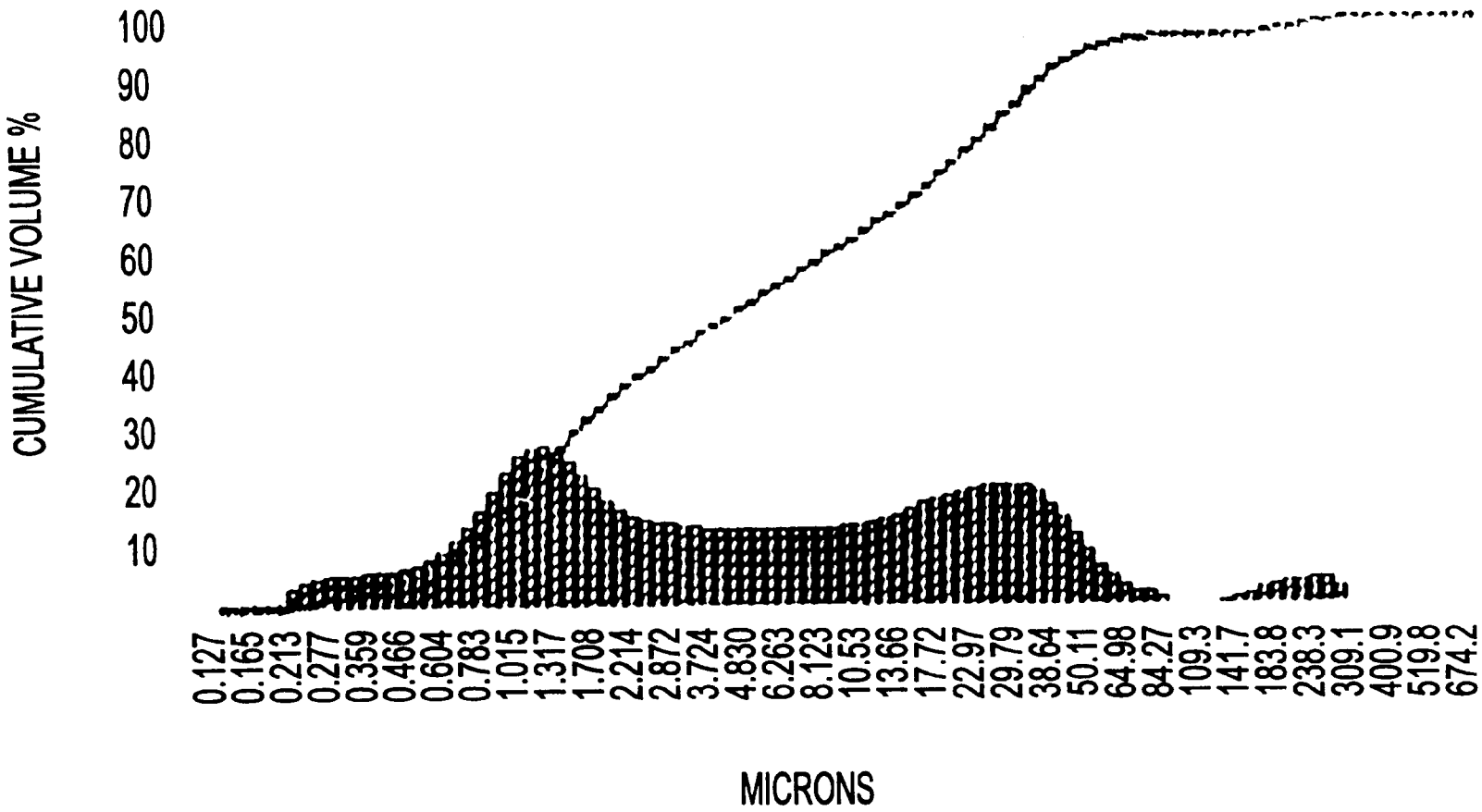
Figure 8:
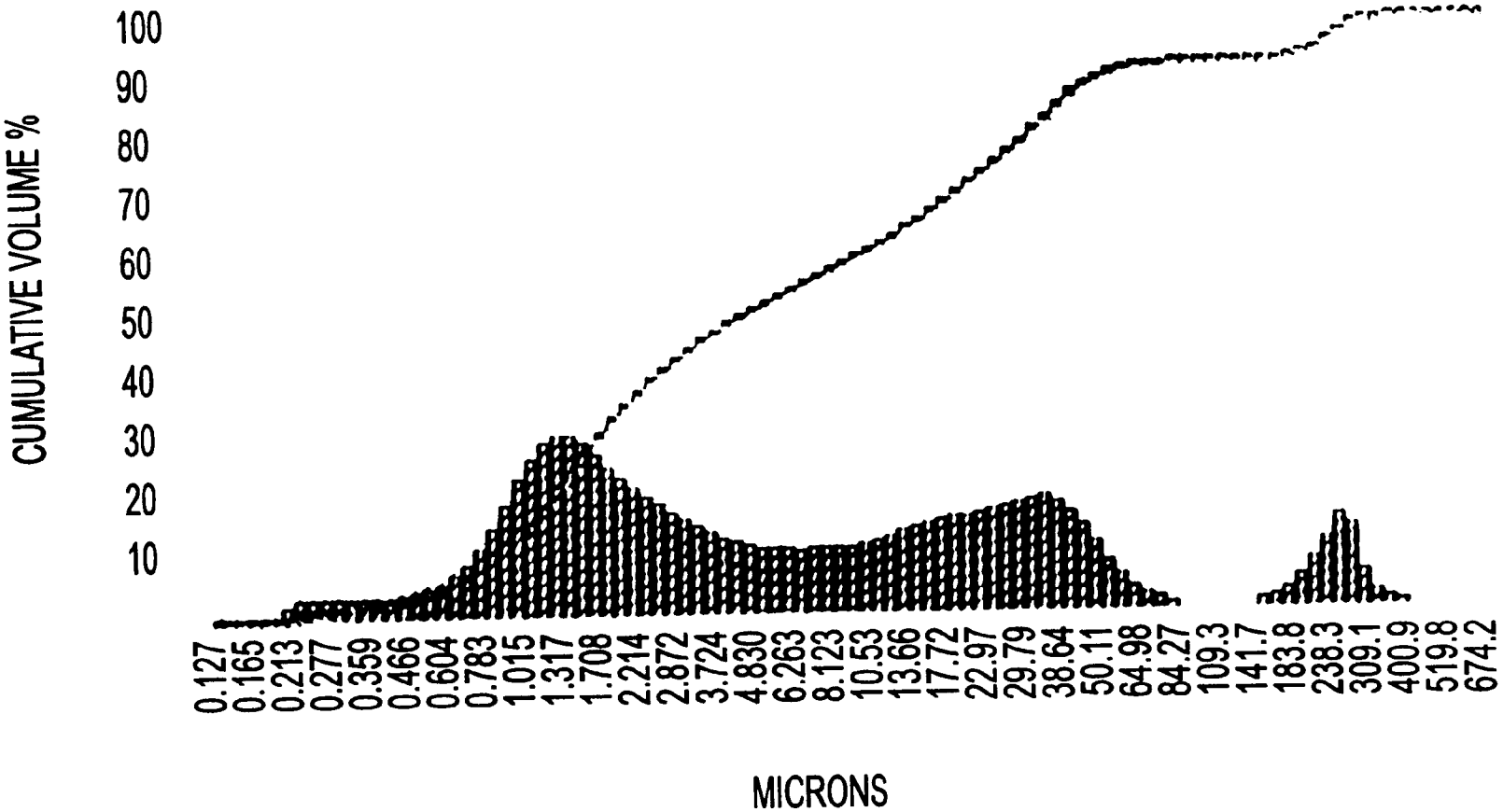
Figure 9:
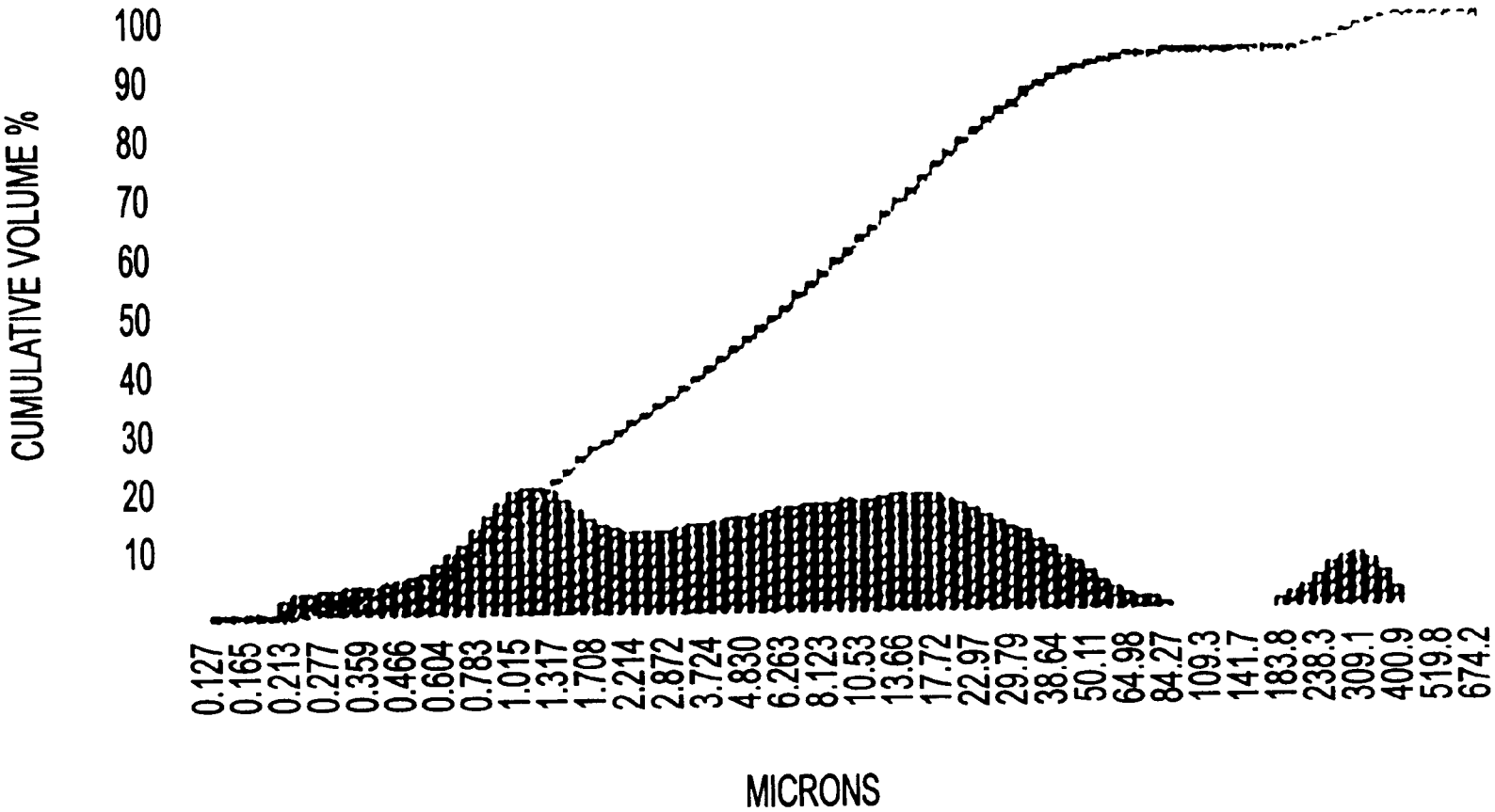

As a further aid to understanding the present invention, FIGS. 1–9 depict particle size distribution data for a 1 kg sample of basaltic ore that has been mechanically attrited for eight hours in accordance with the principles of the present invention. A 50 g sample was pulled every hour and particle size distribution determine. After four hours, the first 1 kg batch was discharged from the attritor and a second 1 kb batch was loaded and 50 g samples pulled every hour after five hours. FIG. 1 shows the particle size distribution data of the sample before mechanical attrition is applied. FIG. 2 shows the particle size distribution data of the sample after one hour of mechanical attrition, etc., and FIG. 9 shows the particle size distribution after eight hours. As a result, the data shows the progressive formation of a relatively coarse phase of particles. The approximate size of these particles typically ranges from about 200 to about 400 microns in diameter. It is believed that this phase of coarser particles generally comprises alloys of various metals derived from the metal counterions that were previously associated with the a.c.s. units and that have been released, reduced, and accreted to larger metal particles during the continuous application of shear deformation forces. In comparison, the remaining fraction of the attrited ore exhibits an average particle size diameter of between about 0.2 to about 75 microns. It is believed that the forces generated during the mechanical attrition process maintains these particles below a maximum diameter. It is the coarser metallic fraction may be analyzed, concentrated, recovered and or extracted using conventional methods.

The advantages of the present invention will be further illustrated in the following, non-limiting Examples. The Examples are illustrative embodiments of the present invention wherein shear deformation forces are generated and applied via mechanical attrition ("M.A.") methods only. The Examples are not intended to limit the claimed invention regarding the materials, conditions, process parameters and the like recited herein. Throughout the Examples, an attrition mill constructed of stainless steel and jacketed for possible water cooling was used. All of the precious element analyses/assays in Examples 1–8 were performed utilizing atomic absorption spectrographic methods combined with microwave pre-digestion of the samples. The values reported represent the amount of troy ounces of element per ton of material/ore. The method of standard additions, as well as matrix matching was used in the analyses.

EXAMPLE 1

Test material: Basaltic scoria from Sheep Hill, Flagstaff, Ariz. Ground in impact mill to −100 mesh.

| | |
|---|---|
| Weight of ore charge: | 1400.0 grams. |
| Grinding media: | 62 lbs. of ⅛ inch diameter stainless steel balls. |
| Balls-to-charge ratio: | 20.1:1 |
| Mill atmosphere: | air tight lid; atmospheric. |
| RPM: | 325 to 350. |
| Cooling jacket/mill temp.: | approximately 90° F. |
| Total time of attrition: | 8 hours. |
| Sintering: | 4 and 8 hour samples sintered 18 hours in electric furnace at 600° C. The head ore sample was not sintered. |

ASSAYS:

| Element | No attrition (1-H) (no flux) | After 4 hrs attrition (1-4) - sintered (no flux) | After 8 hrs attrition (1-8) - sintered (no flux) |
|---|---|---|---|
| Ag | 0.029 | 0.116 | 0.044 |
| Au | 0.281 | 0.422 | 0.612 |
| Pt | 0.784 | 1.385 | 1.455 |
| Pd | 0.541 | 0.658 | 2.799 |
| Rh | 0.175 | 0.816 | 4.374 |
| Ir | 0.637 | 1.468 | 1.050 |

EXAMPLE 2

Test material: Basaltic scoria from Sheep Hill, Flagstaff, Ariz. Ground in impact mill to −100 mesh. Same sample as in Example 1.

| | |
|---|---|
| Weight of ore charge: | 1218.0 grams |
| Metal collector: | 15% by weight of ore of Cu powder (ACu Powder-Grade 165). |
| Weight of Cu powder: | 182.0 grams |
| Total weight of ore charge: | 1400.0 grams. |
| Grinding media: | 62.0 lbs of ⅛ inch diameter stainless steel balls. |
| Balls-to-charge ratio: | 20.1:1 |
| Mill atmosphere: | air-tight lid; atmospheric. |
| RPM: | 325 |
| Cooling jacket/mill temp.: | approximately 90° F. |
| Total time of attrition: | 8 hours. |
| Sintering: | 4 and 8 hour samples were sintered overnight in electric furnace at 600° C. |

ASSAYS:

| Element | No attrition (calculated) (with flux) (1-H) | After 4 hrs attrition (2-4) - sintered (with flux) | After 8 hrs attrition (2-8) - sintered (with flux) |
|---|---|---|---|
| Ag | 0.025 | 0.145 | 0.131 |
| Au | 0.244 | 0.496 | 0.554 |
| Pt | 0.682 | 4.666 | 0.947 |
| Pd | 0.471 | 4.129 | 1.137 |
| Rh | 0.152 | 0.670 | 1.094 |
| Ir | 0.554 | 2.551 | 1.196 |

EXAMPLE 3

Test material: Basaltic scoria from Sheep Hill, Flagstaff, Ariz. Ground in impact mill to −100 mesh. Same sample as in Example 1.

| | |
|---|---|
| Weight of ore charge: | 935 grams |
| Reducing agent: | volumetrically added 230.0 grams of ground charcoal briquettes to fill the volume occupied between 935 grams and 1400 grams of the ore sample. |
| Total weight of ore charge: | 1165.0 grams. |
| Grinding media: | 62.0 lbs of ⅛ inch diameter stainless steel balls. |
| Balls-to-charge ratio: | 24.2:1 |
| Mill atmosphere: | air-tight lid; atmospheric. |
| RPM: | 325 |
| Cooling jacket/mill tem: | 80–90° F. |
| Total time of attrition: | 8 hours. |
| Sintering: | 4 and 8 hour samples were sintered overnight in electric furnace at 600° C. |

ASSAYS:

| Element | No attrition (calculated) (with flux) (1-H) | After 4 hrs attrition (3A-4) Sintered (with flux) | After 4 hrs attrition (3B-4) Unsintered (with flux) | After 8 hrs attrition (3A-8) Sintered (with flux) | After 8 hrs attrition (3B-8) Unsintered (with flux) |
|---|---|---|---|---|---|
| Ag | 0.023 | 0.073 | 0.495 | 0.214 | 0.642 |
| Au | 0.226 | 0.202 | 1.720 | 0.933 | 0.728 |
| Pt | 0.630 | 8.019 | 6.707 | 1.677 | 2.041 |
| Pd | 0.434 | 2.654 | 6.590 | 2.624 | 3.045 |
| Rh | 0.141 | 0.539 | 0.262 | 3.383 | 0.117 |
| Ir | 0.512 | 4.045 | 0.729 | 2.369 | 3.281 |

EXAMPLE 4

Test material: Basaltic scoria from Sheep Hill, Flagstaff, Ariz. Ground in impact mill to −100 mesh. Same sample as in Example 1.

| | |
|---|---|
| Weight of ore charge: | 1225 grams. |
| Initial weight of $NH_4Cl$: | 75 grams. |
| Additional $NH_4Cl$ added: | 90 grams. |
| Total $NH_4Cl$ used in test: | 165 grams. |
| Total weight of ore charge: | 1390 grams. |
| Grinding media: | 43.75 lbs of ⅛ inch diameter stainless steel balls. |
| Balls-to-charge ratio: | 14.3:1 |
| Mill atmosphere: | air-tight lid; atmospheric. |
| RPM: | 425 to 520 at finish of test; 10 amps max. on motor. |
| Cooling jacket/9mill temp.: | 80° F. |
| Total time of attrition: | 4 hours. |

Reduction of the above attrited ore using $NaBH_4$ in a sodium hydroxide suspension (Venmet)

1. The above attrited sample was placed in a 5-gallon plastic bucket and diluted to approximately 4 times its volume with water. A mixer was attached.
2. Over a period of 1 hour 145 ml of conc. HCl was added. The final pH=5.
3. While still under agitation and during an additional period of 2 hours and 15 minutes, 66 ml of Venmet solution (approx. 12% NaBH4) was added incrementally. During this period 55 ml of conc. HCl was incrementally added in order to keep the pH between 5 and 7.
4. Total time of agitation=3 hours and 15 minutes.
5. The reduced solution was vacuum filtered and the residue washed with water. The filter residue was dried a temperature of 95° C.
6. A sample of the dried residue was submitted for atomic absorption analysis of the precious element content (see sample BH-AV).

ASSAY:

| Element | $NaBH_4$ reduced sample (BH-AV) |
|---|---|
| Ag | 0.875 |
| Au | 2.362 |
| Pt | 23.328 |
| Pd | 6.094 |
| Rh | 1.691 |
| Ir | 3.827 |

EXAMPLE 5

Test material: Tertiary and Quaternary fanglomerate deposit within the Lost Basin District south of Lake Mead in northwestern Arizona. The sample is the same in Example 6-A except that the subject material was compiled from six different locations rather than one. Ground in impact mill to −100 mesh.

| | |
|---|---|
| Weight of ore charge: | 1125 grams. |
| Initial weight of NH4Cl: | 75 grams. |
| Additional NH4Cl added: | 90 grams. |
| Total NH4Cl used in test: | 165 grams. |
| Total weight of ore charge: | 1290 grams. |
| Grinding media: | 43.75 lbs of ⅛ inch diameter stainless steel balls. |
| Balls-to-charge ratio: | 17.6:1. |
| Mill atmosphere: | air-tight lid; atmospheric. |
| RPM: | 450 to 500 at finish of test; 10 amps max. on motor. |
| Cooling jacket/mill temp.: | 80° F. |
| Total time of attrition: | 8 hours. |
| Sintering: | none. |

ASSAYS:

| Element | Head ore composite (#4) unground (no flux) | Composite of head ore (#1) ground (no flux) | Composite of head ore ground (Calculated) (with flux) | After 4 hr attrition (#2) (with flux) | After 8 hr attrition (#3) (with flux) |
|---|---|---|---|---|---|
| Ag | 0.140 | 0.124 | 0.108 | 0.160 | 0.262 |
| Au | 0.229 | 0.467 | 0.407 | 0.802 | 1.006 |
| Pt | 0.096 | 0.474 | 0.413 | 1.349 | 3.317 |
| Pd | 0.097 | 0.437 | 0.381 | 1.152 | 2.683 |
| Rh | 0.034 | 0.058 | 0.051 | 0.248 | 0.408 |
| Ir | 0.053 | 0.046 | 0.040 | 0.365 | 1.094 |

EXAMPLE 6

Test material: Basaltic scoria from Sheep Hill, Flagstaff, Ariz. Ground in impact mill to −100 mesh. Same sample as in Example 1.

| | |
|---|---|
| Weight of ore charge: | 1120.0 grams. |
| Metal collector: | 20% by weight of ore of Cu powder (ACu Powder-Grade 165). |
| Weight of Cu powder: | 240.0 grams. |
| Grinding aid: | 75 grams of silica sand. |
| Total weight of ore charge: | 1475.0 grams. |

-continued

| | |
|---|---|
| Grinding media: | 43.75 lbs of ⅛ inch diameter stainless steel balls. |
| Balls-to-charge ratio: | 14.3:1 |
| Mill atmosphere: | air-tight lid; atmospheric. |
| RPM: | started at 450 and finished at 500. |
| Cooling jacket/mill temp. | approximately 80° F. |
| Total time of attrition: | 5 hours. |
| Total recovery of material from attrition: | 1452.0 grams. |

Gas-fired Smelting Test

| Flux formula: | |
|---|---|
| a. Attrited ore from example #8 | 650.0 grams |
| b. Cu powder (mixed thoroughly with ore) | 130.0 grams |
| c. Sodium carbonate | 800.0 grams |
| d. Borax | 400.0 grams |
| e. Silica | 100.0 grams |

The flux and back-charge was thoroughly mixed into a gas-fired furnace being careful not to loose material as the result of dusting and poured into a suitable small cast iron mold. Before pouring, the mold was blackened with carbon. The silicon carbide crucible was first "washed" with sodium carbonate and borax. The final pour was molten and suitably non-viscous.

| | |
|---|---|
| Weight of the Cu bar = 220.4 grams. | |
| Weight of the "Cu" bar after drilling: | 216.8 grams. |
| Weight of "Cu" shot removed from slag: | 1.7 grams. |
| Total "Cu" returned: | 218.5 grams (92.7% recovery). |

ASSAYS:

| Element | Copper bar drillings (8-Cu) | Fluxed and attrited head ore (Copper 5 Hr) | Recovered per ton from smelting (compare with Copper 5 Hr) |
|---|---|---|---|
| Ag | 0.149 | 0.462 | 0.050 |
| Au | 0.124 | 0.790 | 0.042 |
| Pt | 4.709 | 1.397 | 1.583 |
| Pd | 0.595 | 0.049 | 0.200 |
| Rh | 0.694 | 4.180 | 0.233 |
| Ir | 1.704 | 2.734 | 0.573 |

The remaining drilled copper bar (8-Cu) weighed 216.7 grams. To determine whether the electrolytic slimes from this bar reflected proportionally larger recovered precious metal values than the assay from the drillings this bar was anode leached using copper fluoroborate as the electrolyte. The resulting slimes were filtered, washed and dried.

Weight of Cu heel=4.1 grams.

Weight of dried (ashed) slimes (plus ash from filter paper) from Cu bar=8.1 grams.

| Element | Slimes (8-Cu-S) | Recovered per ton from fluxed and attrited head ore (including heel and shot) |
|---|---|---|
| Ag | 112.791 | 1.458 |
| Au | 3.289 | 0.043 |
| Pt | 0.408 | 0.005 |
| Pd | 0.257 | 0.003 |
| Rh | 0.023 | trace |
| Ir | 0.071 | trace |

EXAMPLE 7

Test material: Basaltic scoria from Sheep Hill, Flagstaff, Ariz. Ground in impact mill to −100 mesh. Same sample as in Example 1.

| | |
|---|---|
| Weight of ore charge: | 1400.0 grams. |
| Flux additive: | 10% by weight of ore of NaF powder. |
| Weight of NaF powder: | 140.0 grams. |
| Total weight of ore charge; | 1540.0 grams. |
| Grinding media: | 43.75 lbs of ⅛ inch diameter stainless steel balls. |
| Balls-to-charge ratio: | 14.3:1 |
| Mill atmosphere: | air-tight lid; atmospheric. |
| RPM: | started at 450 and finished at 500. |
| Cooling jacket/mill temp. | approximately 80° F. |
| Total time of attrition: | 5 hours. |
| Total recovery of material from attrition = 1532.3 grams. | |

ASSAYS:

| Element | No attrition (calculated) (fluxed) | After 5 hrs attrition (fluxed) (3 Hr NaF) |
|---|---|---|
| Ag | 0.026 | 0.085 |
| Au | 0.255 | 1.466 |
| Pt | 0.713 | 3.463 |
| Pd | 0.492 | 0.789 |
| Rh | 0.159 | 0.468 |
| Ir | 0.579 | 5.556 |

EXAMPLE 8

Test material: Basaltic scoria from Sheep Hill, Flagstaff, Ariz. Ground in impact mill to −100 mesh. Same sample as in example 1.

| | |
|---|---|
| Weight of ore charge: | 1190.0 grams. |
| Metal collector: | 15% by weight of ore of Pb granules (ASARCO test lead). |
| Weight of Pb granules: | 210.0 grams. |
| Total weight of ore charge: | 1400.0 grams. |
| Grinding media: | 43.75 lbs of ⅛ inch diameter stainless steel balls. |
| Balls-to-charge ratio: | 14.3:1 |
| Mill atmosphere: | air-tight lid; atmospheric. |
| RPM: | started at 450 and finished at 500. |
| Cooling jacket/mill temp.: | approximately 80° F. |
| Total time of attrition: | 5 hours. |
| Total recovery of material from attrition = 1351.9 grams. | |

ASSAYS:

| Element | No attrition (calculated) (fluxed) | After 5 hrs attrition (fluxed) (Pb 5 Hr) |
|---|---|---|
| Ag | 0.029 | 20.852 |
| Au | 0.281 | 3.009 |
| Pt | 0.784 | 0.524 |
| Pd | 0.541 | 4.642 |
| Rh | 0.175 | 1.166 |
| Ir | 0.637 | 0.875 |

ASSAYS:

| Element | After 8 hrs attrition (troy oz per ton) |
|---|---|
| Ag | 0.779 |
| Pd | 1.378 |
| Pt | 1.259 |

From the above Examples, it may be appreciated, without limitation of the invention as claimed, that the application of shear deformation forces to materials, e.g., complex or refractory ores reduces various precursors a.c.s./counterion units to nano-sized materials. At the same time, nano-sized metallic alloys, compounds, etc., are formed in various mixtures between the metal counterions of the a.c.s. units and the gangue elements of the respective ore. The chemistry and metallurgy of these nanophase systems differs somewhat from their coarser counterparts. As a result, metals are rendered extractable or recoverable from the complex or refractory ores.

Those skilled in the art will recognize, or be able to ascertain using no more than routine experimentation, many equivalents to the specific embodiments of the invention specifically described herein. Such equivalents are intended to be encompassed within the scope of the following claims.

What is claimed is:

1. A method for rendering elemental values in a complex or refractory ore detectable or assayable, the method comprising:

(a) obtaining a complex or refractory ore comprising amorphous colloidal silica/counterion units;

(b) applying a sufficient amount of shear deformation forces to the complex or refractory ore to release the counterions from the amorphous colloidal silica/counterion units whereby at least one detectable or assayable element is formed; and (c) collecting the ore.

2. The method of claim 1 wherein the elements are formed by agglomeration of released counterions.

3. The method of claim 1, wherein the shear deformation forces are applied for at least about 4 hours.

4. The method of claim 1 wherein the shear deformation forces are generated by mechanical attrition.

5. The method of claim 1 wherein the shear deformation forces are generated by a ball mill.

6. The method of claim 5, wherein the ball mill is operated at a velocity of about 300 rpm to about 1800 rpm.

7. The method of claim 5, wherein the ball mill is operated at a velocity of about 1000 rpm to about 1400 rpm.

8. The method according to claim 1, wherein said at least one element is gold.

9. A treated ore comprising an extractable or recoverable nanophase metal or metallic alloy the treated ore being obtained by a method comprising the steps of:

(a) obtaining a complex or refractory ore comprising amorphous colloidal silica/counterion units;

(b) applying sufficient shear deformation forces to the complex or refractory ore to release the counterions from the amorphous colloidal silica/counterion units whereby the nanophase metal or metallic alloy is formed; and (c) collecting the treated ore.

10. The treated ore of claim 9, wherein the shear deformation forces are generated by mechanical attrition.

11. The treated ore of claim 9, wherein the shear deformation forces are generated by a ball mill.

12. The treated ore of claim 11, wherein the ball mill is operated at a velocity of about 300 rpm to about 1800 rpm.

13. The treated ore of claim 11, wherein the ball mill is operated at a velocity of about 1000 rpm to about 1400 rpm.

14. The treated ore according to claim 9, wherein the nanophase metal or metallic alloy is formed by agglomeration of released counterions.

15. The treated ore of claim 9, wherein the shear deformation forces are applied for at least about 4 hours.

16. The treated ore according to claim 9, wherein said metal is gold.

* * * * *